US005507627A

United States Patent [19]

Okazaki

[11] Patent Number: 5,507,627

[45] Date of Patent: Apr. 16, 1996

[54] OSCILLATING-PLATE TYPE COMPRESSOR HAVING HOLES IN AN OUTSIDE AREA OF A BOLT LACING PORTION OF A BAFFLE PLATE

[75] Inventor: Michio Okazaki, Kounan, Japan

[73] Assignee: Zexel Corporation, Tokyo, Japan

[21] Appl. No.: 72,740

[22] Filed: Jun. 7, 1993

[30] Foreign Application Priority Data

Jun. 16, 1992 [JP] Japan ..... 4-047935 U

[51] Int. Cl.[6] ..... F04B 39/00

[52] U.S. Cl. ..... 417/312; 417/269

[58] Field of Search ..... 417/269, 540, 417/312; 91/474, 499; 184/6.17

[56] References Cited

U.S. PATENT DOCUMENTS

| | | | |
|---|---|---|---|
| 1,927,947 | 9/1933 | Newell | 417/312 |
| 4,290,345 | 9/1981 | Hiraga et al. | 417/269 |
| 4,715,790 | 12/1987 | Iijima et al. | 417/269 |

FOREIGN PATENT DOCUMENTS

| | | | |
|---|---|---|---|
| 4143468 | 5/1992 | Japan | 417/269 |
| 4-129886 | 11/1992 | Japan . | |

*Primary Examiner*—Richard A. Bertsch
*Assistant Examiner*—William Wicker
*Attorney, Agent, or Firm*—Frishauf, Holtz, Goodman, Langer & Chick

[57] ABSTRACT

An oscillating-plate type compressor has five cylinder bores 6 formed in a cylinder block 1. Coolant gas compressed in the cylinder bores is discharged to a discharge chamber 12 through discharge valves 17 secured to the cylinder block 1 by means of a bolt 19. The discharge chamber 12 is separated by a baffle plate 14 into two discharge spaces 12*a* and 12*b*, the former containing a bolt head 19*a* and the latter communicating with the discharge port. Five holes 14*a* to 14*e* which are the same in number as that of the cylinder bores 6 are formed and arranged along an imaginary circle of a predetermined diameter around the bolt facing portion 28 of the baffle plate 14 so as to communicate both of the discharge spaces 12*a* and 12*b* with each other.

12 Claims, 3 Drawing Sheets

OSCILLATING-PLATE TYPE COMPRESSOR HAVING HOLES IN AN OUTSIDE AREA OF A BOLT LACING PORTION OF A BAFFLE PLATE

BACKGROUND OF THE INVENTION

1. Field of the Invention

The present invention relates to an oscillating-plate type compressor, and in particular to an oscillating-plate type compressor enabling prevention of a generation of discharge malfunctioning phenomena due to a loose bolt for securing a discharge valve.

2. Description of the Prior Art

A conventional oscillating-plate type compressor shown in FIG. 4 has been proposed by Japan Utility Model Application No. 45937/1991. According to the prior art, a plurality of cylinder bores 6 are formed in a cylinder block 1, discharge valves 17 for discharging coolant gas compressed in these cylinder bores 6 are secured to the cylinder block 1 by bolts 19, a discharge chamber 12 is separated by a baffle plate 114 into a discharge space 12*a* at a side of a discharge valve 17 and another discharge space 12*b* communicated to a discharge port (not shown), and both of the discharge spaces 12*a* and 12*b* are communicated through a single hole 114*a* formed in the baffle plate 114.

According to the prior art pulsation decreasing mechanism, the piston 7 slides in the cylinder bore 6 due to oscillation of the oscillating plate 10 so as to press coolant gas in the cylinder bore 6. When a pressure of the coolant gas reaches a predetermined level, the discharge valve 17 opens, and coolant gas is once discharged into the discharge space 12*a* of the discharge chamber 12 through a discharge port 16. Furthermore, the coolant gas in the discharge space 12*a* is squeezed by a hole 114*a* of the baffle plate 114, flows into the discharge space 12*b* and is discharged through the discharge port.

As described above, the pulsation phenomenon of discharging gas is prevented by separating the discharge chamber 12 into two discharge spaces 12*a* and 12*b* by means of a baffle plate 114, and communicating both the discharge spaces 12*a* and 12*b* through a single hole 114*a* formed in the baffle plate 114.

According to the conventional pulsation decreasing mechanism of the oscillating-plate type compressor, the hole 114*a* for leading or communicating coolant gas from the discharge space 12*a* to another discharge space 12*b* is placed at a center of the baffle plate 114 facing the bolt head 19*a* as shown in FIG. 4. When the bolt 19 is loosens, it covers or clogs the hole 114*a* of the baffle plate 114, resulting in not only a decrease of pulsation decrease function, but also the interior pressure of the discharge space 12*a* rises due to malfunctioning of discharge and high pressure in the discharge space 12*a* is applied to the partition wall 3*a* of the rear head 3 separating the discharge chamber 12 from the intake chamber 13.

Accordingly, a particular portion of the partition wall 3*a* is strained, thereby generating large deformation of the strained portion.

SUMMARY OF THE INVENTION

It is the purpose of the present invention to provide an oscillating-plate type compressor enabling prevention of the discharge valve securing bolt from covering or clogging holes of the baffle plate resulting in a discharge malfunction of the compressor after the bolt loosens.

According to the present invention, any holes formed in the baffle plate are not covered even if the discharge valve securing bolt loosens and its bolt head comes into contact with the bolt facing portion of the baffle plate. Coolant gas supplied into the discharge valve side discharge space from the cylinder bore can be sent into the discharge port side discharge space, attaining a stable pulsation decrease function. In addition, pressure of the discharge valve side discharge space can not abnormally rise, and therefore it is possible to prevent portions of the mechanism from being exceedingly deformed due to a pressure rising.

Characteristics of the improvement of the oscillating-plate type compressor according to the present invention will be described.

The improvement has:

a plurality of cylinder bores, respectively formed in the cylinder block;

discharge valves for discharging coolant gas compressed in the cylinder bore into the discharge chamber;

a baffle plate separating the discharge chamber into the discharge valve side discharge space containing the discharge valve and the discharge port side discharge space communicated with the discharge port; and a plurality of holes formed in the baffle plate so as to communicate a discharge space with another discharge space.

Preferably, the oscillating-plate type compressor according to the present invention comprises;

a plurality of cylinder bores, respectively formed in the cylinder block;

discharging valves, respectively secured to the cylinder block by means of bolts so as to discharge coolant gas compressed in the cylinder bore into the discharge chamber, and a baffle plate for separating the discharge chamber into a discharge valve side discharge space containing said discharge valve and the bolt head and a discharge port side discharge space connected to said discharge port, wherein a plurality of holes are formed in the baffle plate in order to communicate both the discharge spaces with each other.

Preferably, the number of the plural holes formed in the baffle plate is made the same as that of the cylinder bore.

More preferably, the plural holes formed in the baffle plate are arranged along an imaginary circle of a predetermined diameter around the center of the bolt facing portion of the baffle plate, and both of the discharge spaces are communicated with each other.

Still more preferably, the plural holes described above are arranged along the imaginary circle of a predetermined diameter at regular intervals around the bolt facing portion of the baffle plate, and the discharge spaces are made to communicate with each other.

Preferably, the oscillating-plate type compressor of the present invention comprises:

five cylinder bores formed in the cylinder block;

discharge valves secured to the cylinder block by bolts so as to discharge coolant gas into the discharge chamber after the gas is compressed in the cylinder bore; and a baffle plate for separating the discharge chamber into the discharge valve side discharge space containing the bolt head and the discharge port side discharge space communicated with the discharge port;

wherein the five holes are formed along an imaginary circle of a predetermined diameter around the center of the bolt facing portion of the baffle plate and both of the discharge spaces are communicated with each other.

More preferably, the bolt has a guide hole for leading coolant gas in the discharge valve side discharge space into the crank chamber.

DETAILED DESCRIPTION OF THE PREFERRED EMBODIMENT

A preferred embodiment of the pulsation decreasing mechanism of the oscillating-plate type compressor according to the present invention will be described in detail with reference to the accompanying drawings.

Figure 1:
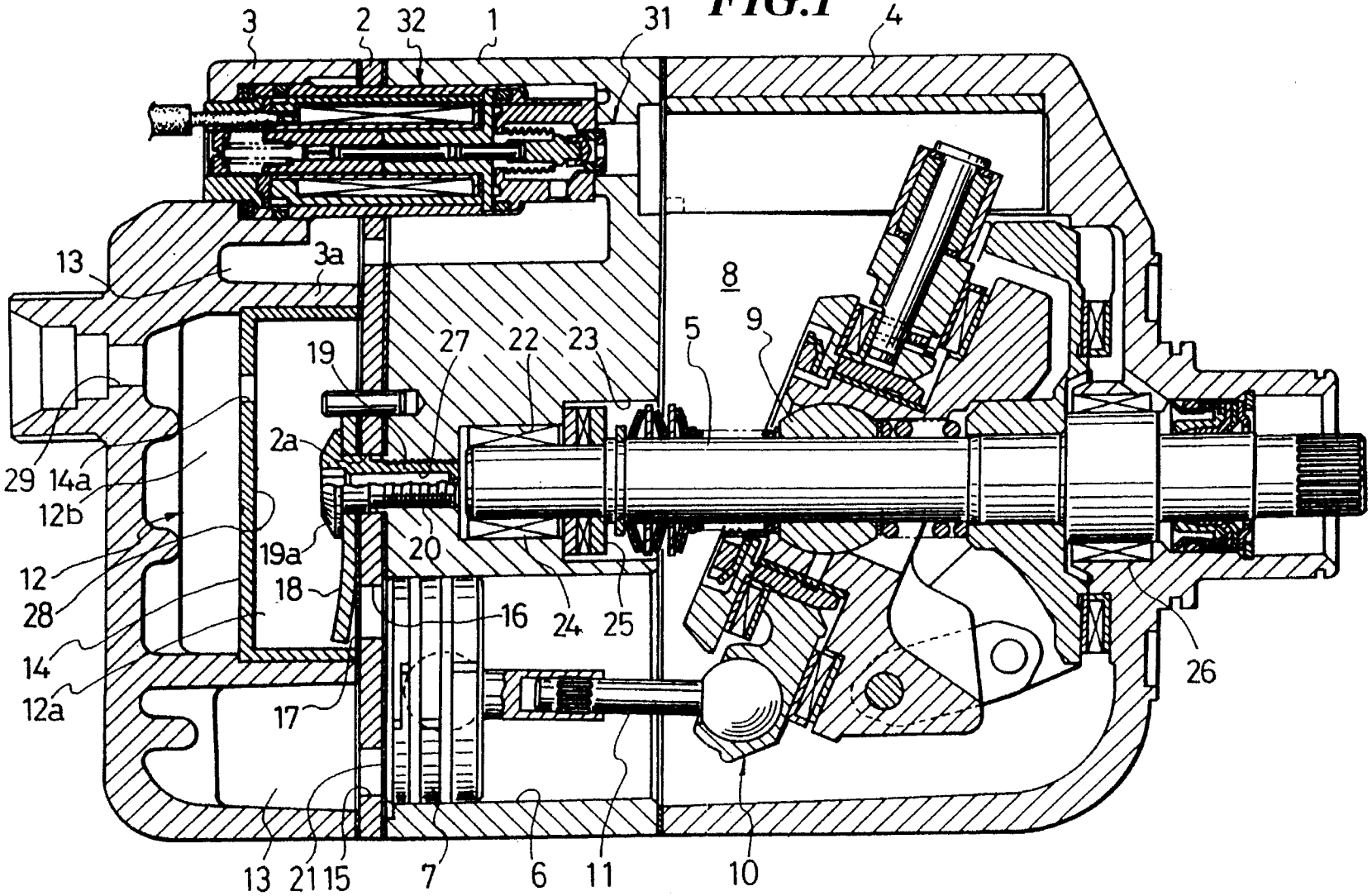
FIG. 1 is a longitudinal sectional view of the oscillating-plate type compressor provided with the pulsation decreasing mechanism according to the embodiment of the present invention.

As shown in FIG. 1 depicting a longitudinal sectional view of the oscillating-plate type compressor provided with the pulsation decreasing mechanism according to the preferred embodiment of the present invention, a rear head 3 is secured to one end face of the cylinder block 1 of the compressor through a valve plate 2 and a front head 4 is secured to another end face of the cylinder block 1.

The cylinder block 1 has five cylinder bores 6 placed and arranged around a drive shaft 5 along its circumferential direction at a predetermined or regular interval. In respective cylinder bores 6, five pistons 7 are slidably contained as usual.

The front head 4 has a crank chamber 8 formed therein and the crank chamber 8 contains an oscillating plate 10 adapted to oscillate around a hinge ball 9 in cooperation to revolutions of the drive shaft 5. This oscillating plate 10 is connected to the piston 7 through a connecting rod 11. Oscillating motion of the oscillating plate 10 drives reciprocally the piston 7 within the cylinder bore 6. When pressure in the crank chamber 8 decreases, a slanting angle of the oscillating plate 10 increases. On the contrary, when pressure in the crank chamber 8 increases, the slanting angle of the oscillating plate 10 decreases.

Figure 2:
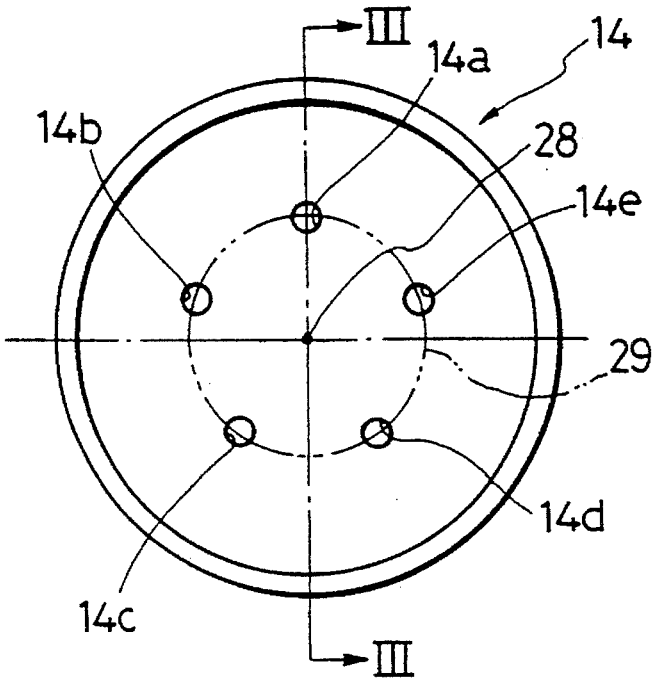
FIG. 2 is a plan view of the baffle plate.
Figure 3:
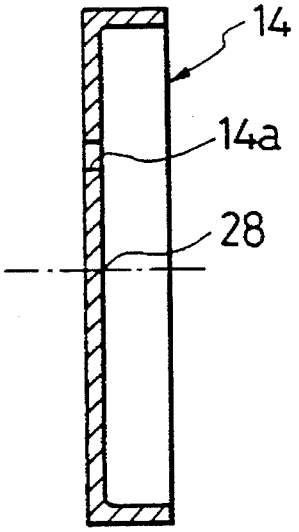
FIG. 3 is a sectional view of the baffle plate taken along line III—III shown in FIG. 2.
Figure 4:
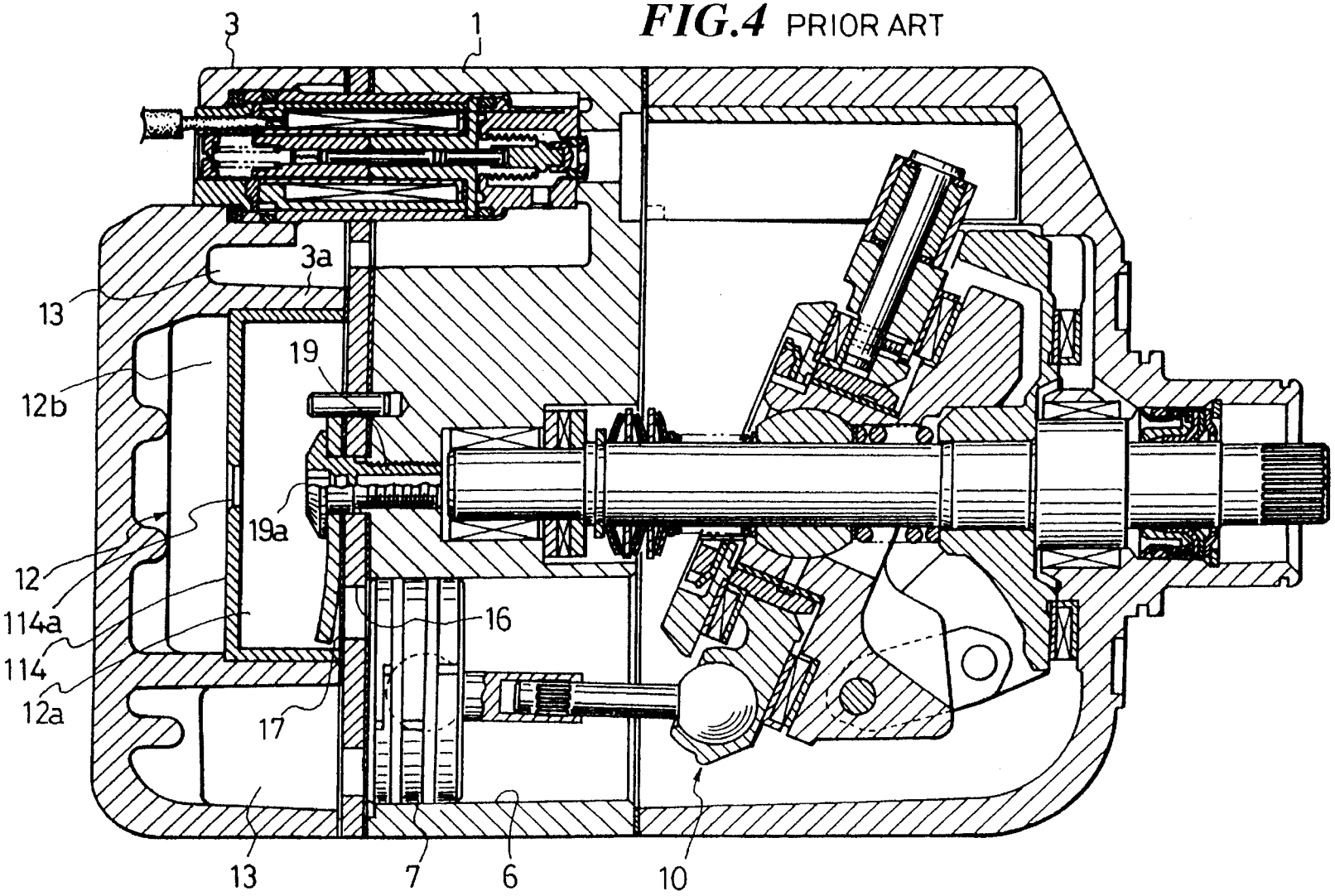
FIG.4 PRIOR ART
FIG. 4 is a longitudinal sectional view of the oscillating-plate type compressor provided with a conventional pulsation decreasing mechanism.

The rear head 3 has a discharge chamber 12 led to a discharge port 29 and intake chambers 13 placed around the discharge chamber 12, and the discharge chamber 12 and the intake chambers 13 are formed in the rear head 3. The discharge chamber 12 and the intake chamber 13 are separated by a partition wall 3*a* constituting a part of the rear head 3. An interior space of the discharge chamber 12 is separated into a discharge space (a discharge space at a side of the discharge valve) 12*a* and another discharge space (a discharge space at a side of the discharge port ) 12*b* by means of a disc-like baffle plate 14 pressed into the partition wall 3*a*. As shown in FIG. 2 and FIG. 3, the baffle plate 14 has five holes 14*a* to 14*e* which is the same number as that of the cylinder bores 6. These holes 14*a* to 14*e* formed in the baffle plate 14 are placed along an imaginary circle 29 of a predetermined radius around a bolt-head facing portion 28 of baffle plate 14 at regular intervals. Each the discharge space 12*a* and each discharge space 12*b* are led to each other through five holes 14*a* to 14*e*.

The valve plate 2 has, as shown in FIG. 1, a discharge port 16 leading the cylinder bore 6 to the discharge space 12*a*, and an intake port 15 connecting the cylinder bore 6 and the intake chamber 13. Respective discharge ports 16 and intake ports 15 are formed along a circumferential circle of the valve plate 2 at a regular interval. The discharge port 16 is adapted to open and shut by a discharge valve 17. The discharge valve 17 is secured to an end face of the valve plate 2 at a side of the rear head by a bolt 19 together with a valve holder 18. The bolt 19 is threaded in a threaded hole 20 of the cylinder block 1 through a center hole 2*a* of the valve plate 2. In addition, the intake port 15 is adapted to open and shut by an intake valve 21 placed between the valve plate 2 and the cylinder block 1.

The cylinder block 1 has a thread hole or screw hole 20, a small diameter hole 22, and a large diameter hole 23, respectively formed at a central portion of the cylinder block 1 along its center line. The bolt 19 has a guide hole 27 formed therein so as to lead high pressure coolant gas in the discharge space 12*a* to the small diameter hole 22 of the cylinder block 1. The small diameter hole 22 contains a radial bearing 24 and the large diameter hole 23 contains a thrust bearing 25. The radial bearing 24 and thrust bearing 25 hold an end portion of the drive shaft 5 at a rear side. An end portion of the drive shaft 5 at a front side is held or supported by a radial bearing 26 in the front head 4.

It is noted that the cylinder block 1 has a leading passage 31 leading the intake chamber 13 to the crank chamber 8. A pressure regulator valve 32 is installed at a mid position of the leading passage 31 in order to control pressure in the intake chamber 13 and to control the pressure in the crank chamber 8.

Operation of the oscillating-plate type compressor provided with the pulsation decreasing mechanism according to the present invention will be described.

When rotary power of an engine (not shown) mounted on a car is transferred to the drive shaft 5, the oscillating plate 10 oscillates in cooperation with rotation of the drive shaft 5. The oscillating plate 10 drives the piston 7 to oscillate within the cylinder bore 6, and thereby a volume of the interior of the cylinder bore 6 changes. Consequently, intake, compression and discharge operations of the coolant gas are sequentially done and a volume of high-pressure coolant gas is discharged, which volume is in accordance with the slanting angle of the oscillating plate 10.

When the when thermal load of the compressor decreases, the pressure control valve 32 closes a communicating passage 31, thereby increasing the pressure in the crank 8 and decreasing the slanting angle of the oscillation plate 10, so that a stroke length of the piston 7 decreases, thus diminishing the discharging volume of the compressor. Then, high-pressure coolant gas in the discharge space 12*a* is led into the small diameter hole 22 through a guide hole 27 of the bolt 19, and led into the crank chamber 8 through the large diameter hole 23 accelerating pressure rising in the crank chamber 8, and thereby simultaneously the radial bearing 24 and the thrust bearing 25 are lubricated.

When the thermal load of the compressor increases, the pressure control valve 32 opens the communicating passage 31, and pressure in the crank chamber 8 decreases, and the slanting angle of the oscillating plate 10 increases, as a result, the stroke length of the piston 7 increases, thereby increasing the discharging volume.

When the piston 7 compresses coolant gas in the cylinder bore 6 and pressure of the gas reaches a predetermined level, the discharge valve 17 opens and the coolant gas is continuously discharged into the discharge space 12*a* through the discharge ports 16. It is noted that the baffle plate 14 has holes 14*a* to 14*e* of a number corresponding to that of the cylinder bores 6, and therefore the coolant gas flown-in through the discharge ports 16 is sequentially discharged from one of the holes 14*a* to 14*e* nearest to the discharge port 16 into the discharge space 12*b* resulting in no generation of overlapped-pulsations.

If the bolt 19 loosens and its head 19*a* comes into contact with the bolt facing portion 28 placed at a center of the baffle plate 14, any one of the holes 14*a* to 14*e* formed in the baffle plate 14 is not covered with the bolt head 19*a*, because these holes 14*a* to 14*e* are arranged spaced from the bolt facing portion 28 and along the imaginary circle 29 of a predetermined diameter around the bolt facing portion 28 of the baffle plate 14. Consequently, it is possible to attain a stable pulsation restraint function. Further, pressure of the discharge space 12*a* does not rise abnormally so as not to damage the partition wall 3*a* of the rear head 3.

It is noted that the above-described embodiment of the present invention relates to a case where the present invention is applied to a variable-volume and oscillation plate type compressor. However it is apparent that, when the present invention is embodied in compressors of other types, such as a fixed-volume and oscillation plate type compressor, the same operative effect as that of the embodiment above-described is attained.

I claim:

1. In an oscillating-plate type compressor comprising a plurality of cylinder bores, respectively formed in a cylinder block; discharge valves for discharging coolant gas compressed in said cylinder bores into a discharge chamber; at least one bolt having a bolt head, for securing the discharge valves to the cylinder block; and a baffle plate for separating the discharge chamber into a discharge valve side discharge space containing said discharge valves and the bolt head, and a discharge port side discharge space coupled to a discharge port of the compressor, said baffle plate having a bolt-head facing portion which faces the bolt head of said at least one bolt, the improvement comprising:

a pulsation decreasing means, including a plurality of holes formed in the baffle plate and through which both of the discharge spaces communicate with each other, for decreasing pressure pulsations during operation of the compressor; and said plurality of holes being arranged in an area of the baffle plate which is spaced from the bolt-head facing portion of the baffle plate.

2. The oscillating-plate type compressor according to claim 1, wherein said at least one bolt has a guide hole therein for guiding coolant gas in said discharge valve side space to a crank chamber of the compressor.

3. The oscillating-plate type compressor according to claim 1, wherein the number of said plurality of holes is the same as the number of said cylinder bores.

4. The oscillating-plate type compressor according to claim 3, wherein said at least one bolt has a guide hole therein for guiding coolant gas in said discharge valve side space to a crank chamber of the compressor.

5. The oscillating-plate type compressor according to claim 1, wherein said plurality of holes are arranged along an imaginary circle which is in said area of the baffle plate which is spaced from said bolt-head facing portion of the baffle plate.

6. The oscillating-plate type compressor according to claim 5, wherein said at least one bolt has a guide hole therein for guiding coolant gas in said discharge valve side space to a crank chamber of the compressor.

7. The oscillating-plate type compressor according to claim 5, wherein said plurality of holes are arranged substantially at same intervals along said imaginary circle.

8. The oscillating-plate type compressor according to claim 7, wherein said at least one bolt has a guide hole therein for guiding coolant gas in said discharge valve side space to a crank chamber of the compressor.

9. The oscillating-plate type compressor according to claim 5, wherein the number of said plurality of holes is the same as the number of said cylinder bores.

10. The oscillating-plate type compressor according to claim 9, wherein said at least one bolt has a guide hole therein for guiding coolant gas in said discharge valve side space to a crank chamber of the compressor.

11. The oscillating-plate type compressor according to claim 9, wherein said plurality of holes are arranged substantially at same intervals along said imaginary circle.

12. The oscillating-plate type compressor according to claim 11, wherein said at least one bolt has a guide hole therein for guiding coolant gas in said discharge valve side space to a crank chamber of the compressor.

* * * * *